US007673666B2

(12) United States Patent
Fan

(10) Patent No.: US 7,673,666 B2
(45) Date of Patent: Mar. 9, 2010

(54) MODULAR WINDOW BLIND ASSEMBLY

(75) Inventor: Chiu-Lan Fan, Taichung (TW)

(73) Assignee: Top-Wind Enterprises Co., Ltd., Taichung (TW)

( * ) Notice: Subject to any disclaimer, the term of this patent is extended or adjusted under 35 U.S.C. 154(b) by 519 days.

(21) Appl. No.: 11/509,689

(22) Filed: Aug. 25, 2006

(65) Prior Publication Data

US 2007/0267152 A1 Nov. 22, 2007

(30) Foreign Application Priority Data

May 16, 2006 (TW) ..... 95117285 A

(51) Int. Cl.
*A47H 5/00* (2006.01)

(52) U.S. Cl. ..... 160/84.04; 160/84.05; 160/84.06; 160/206; 160/34; 160/35; 160/36; 160/381

(58) Field of Classification Search ..... 160/84.04, 160/84.05, 84.06, 206, 34, 35, 36, 381
See application file for complete search history.

(56) References Cited

U.S. PATENT DOCUMENTS 4,862,941 A * 9/1989 Colson ..... 160/84.02
5,456,303 A * 10/1995 Horinouchi ..... 160/84.04
5,522,445 A * 6/1996 Hoffman ..... 160/183
5,937,929 A * 8/1999 Chen ..... 160/370.23
5,979,533 A * 11/1999 Dupuie ..... 160/84.06
6,463,985 B1 * 10/2002 Hsu ..... 160/84.04
6,546,681 B1 * 4/2003 Trundle ..... 52/202
6,766,847 B1 * 7/2004 Wang ..... 160/199
7,395,850 B2 * 7/2008 Chino et al. ..... 160/243
2007/0029053 A1 * 2/2007 Moriya et al. ..... 160/84.06
2008/0135189 A1 * 6/2008 Okachi et al. ..... 160/84.06

FOREIGN PATENT DOCUMENTS

TW 510427 * 4/1991
TW 525706 7/1991

* cited by examiner

*Primary Examiner*—Katherine W Mitchell
*Assistant Examiner*—Philip S Kwon
(74) *Attorney, Agent, or Firm*—Pillsbury Winthrop Shaw Pittman, LLP

(57) ABSTRACT

A modular window blind assembly includes a blind-mounting frame adapted to be mounted on a window/door frame and including two vertical frame members and two horizontal frame members, a pleated blind having top and bottom ends connected detachably and respectively to the horizontal frame members, and a slide mounted detachably between and slidable relative to the horizontal frame members. First and second positioning plates are provided respectively at two opposite ends of the pleated blind between the top and bottom ends of the same. The first positioning plate is connected detachably to one of the vertical frame members. The slide is connected detachably to the second positioning plate, and has a receiving space to receive substantially entirely the pleated blind when the pleated blind is folded.

7 Claims, 12 Drawing Sheets

MODULAR WINDOW BLIND ASSEMBLY

CROSS-REFERENCE TO RELATED APPLICATION

This application relies for priority upon Taiwanese Application No. 095117285, filed on May 16, 2006. the contents of all of which are incorporated herein by reference in their entireties.

BACKGROUND OF THE INVENTION

1. Field of the Invention

The invention relates to a window blind assembly, more particularly to a modular window blind assembly.

2. Description of the Related Art

A conventional window blind assembly, as disclosed by the applicant in Taiwanese Patent No. 226545 and as shown in FIG. 1, includes a pleated blind 20 mounted on a blind-mounting frame 30. The entire assembly of the pleated blind 20 and the blind-mounting frame 30. is fastened to an outer side of a window/door frame 60.

Another conventional window blind assembly, as disclosed by the application Taiwanese Patent No. 525706 and as shown in FIG. 2, includes an assembly of a pleated blind 40 and a blind-mounting frame 50 fitted within a window/door frame 100.

Although each of the aforementioned conventional window blind assemblies can achieve its intended purpose, when one of the components, such as a cord, a portion of the pleated blind 20, 40, etc., is damaged, the entire assembly of the pleated blind 20, 40 and the blind-mounting frame 30, 50 must be removed first from the window/door frame 60, 100 in order to repair or replace the damaged component. Not only is the repair or replacement of the conventional window blind assembly inconvenient, but damage to the window/door frame 60, 100 is also possible during removal of the assembly. Further, because the removed pleated blind 20, 40 is bulky, it is difficult to make the repair on the spot, and difficult also to transport the pleated blind 20, 40 to a factory for repair.

SUMMARY OF THE INVENTION

Therefore, the object of the present invention is to provide a modular window blind assembly that has a pleated blind that can be easily removed for repair or replacement and that can be folded to a compact size after removal to allow for convenient transport.

According to one aspect of this invention, a modular window blind assembly comprises a blind-mounting frame, a pleated blind, and a slide. The blind-mounting frame is adapted to be mounted on a window/door frame, and includes two vertical frame members, and two horizontal frame members between the vertical frame members. The pleated blind has top and bottom ends connected detachably and respectively to the horizontal frame members, and opposite first and second positioning plates provided respectively at two opposite ends of the pleated blind between the top and bottom ends. The first positioning plate is connected detachably to one of the vertical frame members. The slide is mounted detachably between and is slidable relative to the horizontal frame members. The slide is connected detachably to the second positioning plate, and has a receiving space to receive substantially entirely the pleated blind when the pleated blind is folded.

According to another aspect of this invention, a modular window blind assembly comprises a blind-mounting frame, a pleated blind, and at least one retaining member. The blind-mounting frame is adapted to be mounted on a window/door frame, and includes two vertical frame members, and two horizontal frame members between the vertical frame members. One of the vertical frame members has two spaced-apart side plates, an end plate interconnecting the side plates, and two flange plates projecting from inner surfaces of the side plates toward each other and defining a passage there between. The pleated blind has top and bottom ends connected detachably and respectively to the horizontal frame members, and a first positioning plate provided at one end of the pleated blind between the top and bottom ends. The first positioning plate spans the passage, and is placed removably between the end plate and each of the flange plates. The retaining member is inserted removably into the one of the vertical frame members, and spans the passage. The retaining member has opposite first and second ends each of which extends in between the first positioning plate and one of the flange plates so that the first positioning plate is prevented from moving out of the one of the vertical frame members.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
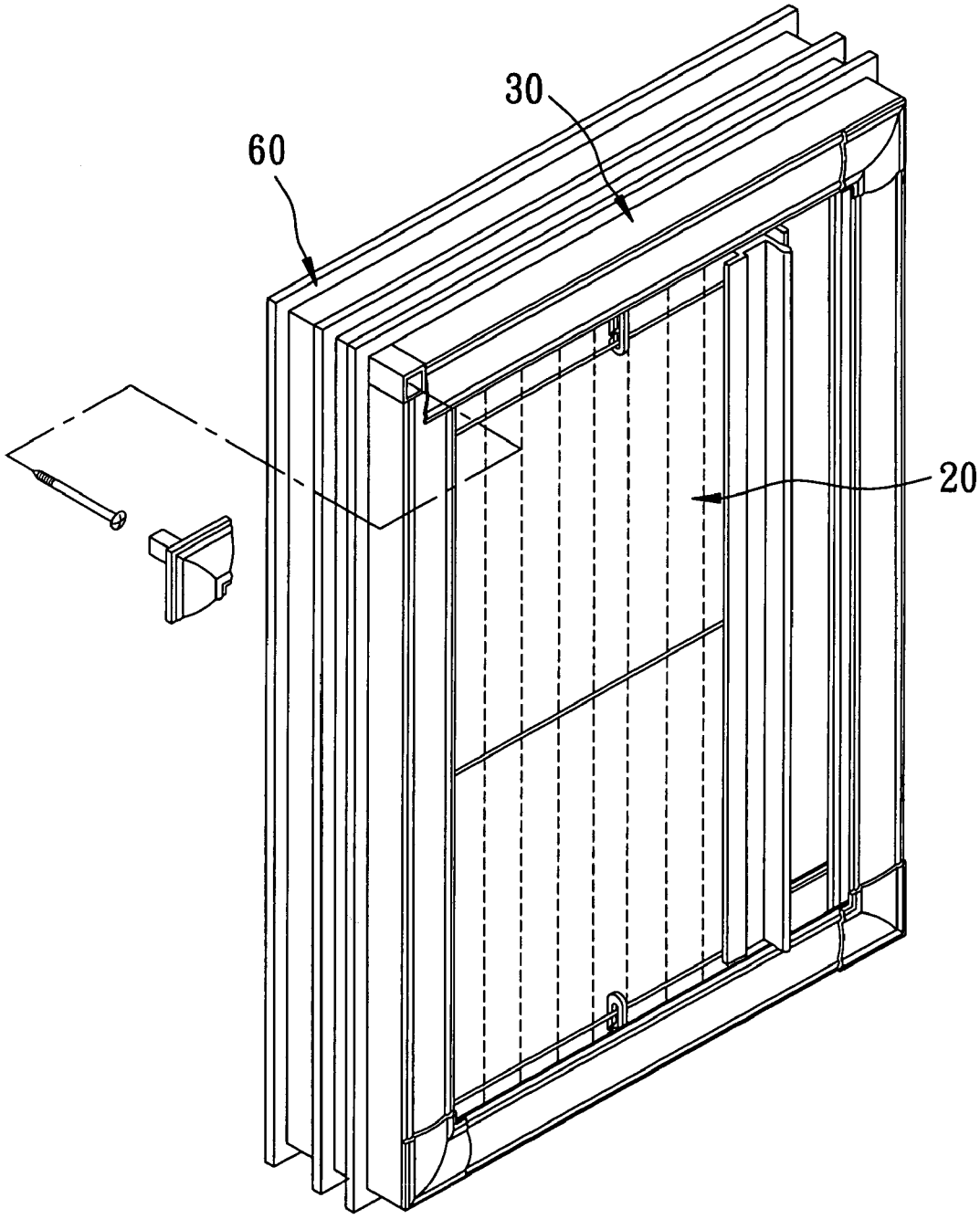
FIG. 1 PRIOR ART
FIG. 1 is a perspective view of a conventional window blind assembly as disclosed in Taiwanese Patent No. 226545.
Figure 2:
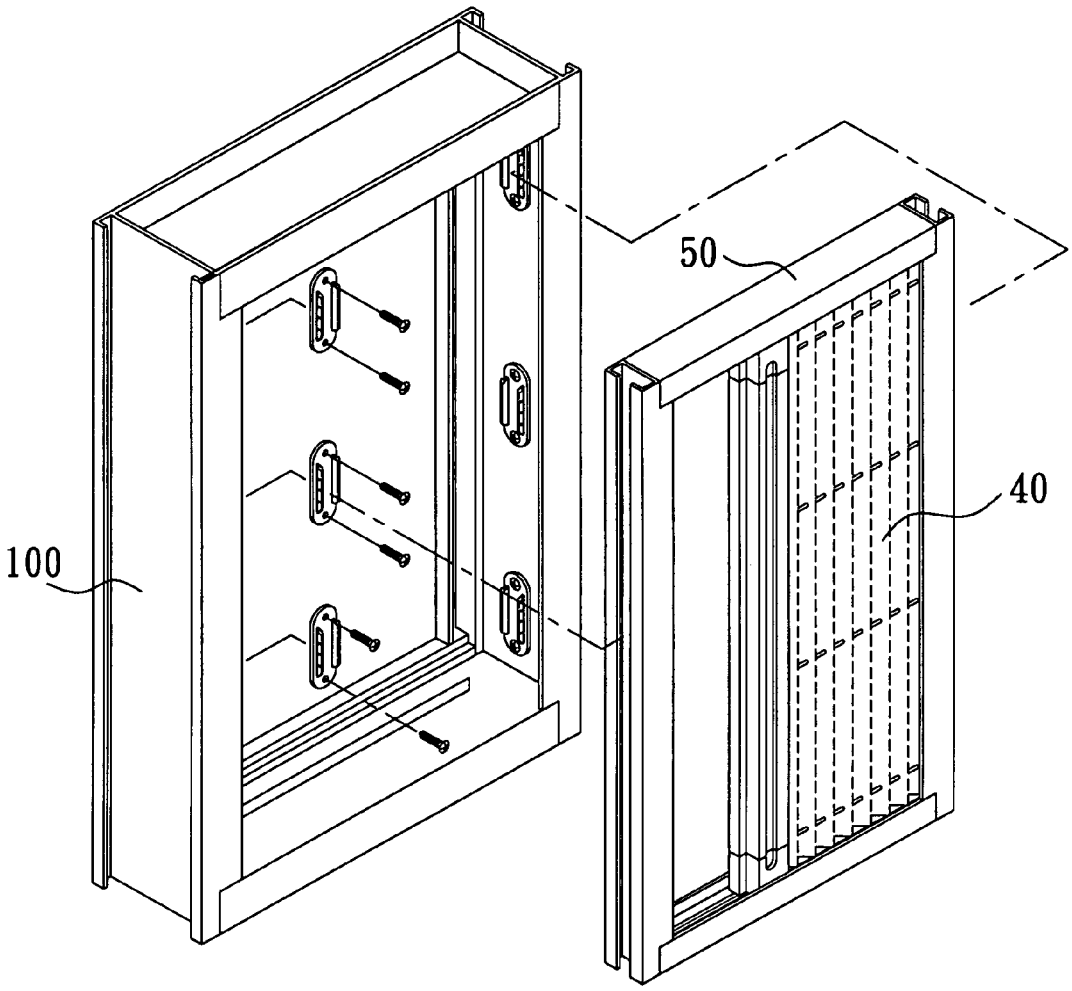
FIG. 2 PRIOR ART
FIG. 2 is a perspective view of a conventional window blind assembly as disclosed in Taiwanese Patent No. 525706.

Before the present invention is described in greater detail, it should be noted that like elements are denoted by the same reference numerals throughout the disclosure.

Referring to FIGS. 3 to 11, the first preferred embodiment of a modular window blind assembly according to the present invention is shown to comprise a blind-mounting frame 1, a slide 2, and a pleated blind 3.

The blind-mounting frame 1 is adapted to be mounted on a window/door frame (not shown), and includes left and right vertical frame members 12, two horizontal frame members 11 between the left and right vertical frame members 12 and cooperating with the same to define a window opening 10, four corner connectors 13, and four decorative elements 14. Each of the horizontal and vertical frame members 11, 12 has a substantially U-shaped cross section, and has two spaced-apart side plates 111, 121, an end plate 112, 122 interconnecting the side plates 111, 121, and two flange plates 114, 124 projecting respectively from inner surfaces of the side plates 111, 121 toward each other, defining a passage 1141, 1241 therebetween, and dividing the corresponding frame member 11, 12 into first and second channels 113, 115, 123, 125.

Each of the corner connectors 13 includes two insert legs 131 inserted respectively into one end of the first channel 113 of one of the horizontal frame members 11 and one end of the first channel 123 of the corresponding vertical frame member 12, a through hole 132 formed between the insert legs 131, and an engaging groove 133 formed between the insert legs 131 adjacent to the through hole 132.

Each of the decorative elements 14 includes a decorative plate 142 covering the through hole 132 in the respective connector 13, and a protrusion 141 projecting into the through hole 132 of the corresponding connector 13.

Figure 7:
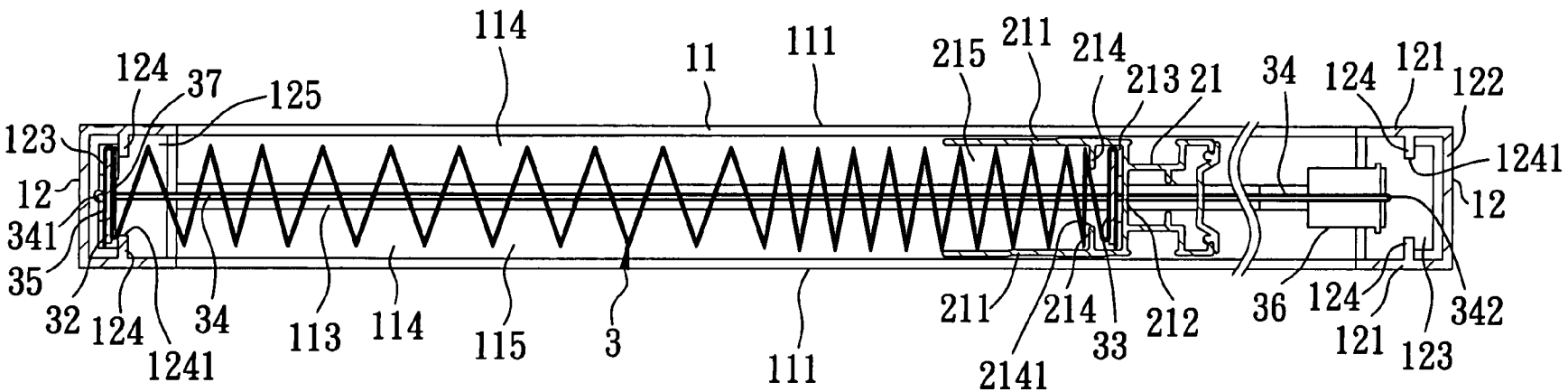
FIG. 7 is a fragmentary sectional view of the first preferred embodiment taken along line VII-VII of FIG. 5.

The slide 2 is mounted detachably between and is slidable relative to the horizontal frame members 11, and, as shown in FIG. 7, includes a slide body 21, two spaced-apart vertically extending wing plates 211, a vertically extending cross plate 212 interconnecting the wing plates 211 and connected to the slide body 21, and two vertically extending ribs 214 projecting respectively from inner surfaces of the wing plates 211 toward each other and defining a passage 2141 therebetween. The wing plates 211 and the cross plate 212 cooperatively define a receiving space. The ribs 214 divide the receiving space into a blind-engaging groove 213 adjacent to the cross plate 212, and a blind-receiving groove 215 away from the cross plate 212.

The slide 2 further includes two roller supports 22 connected detachably and respectively to top and bottom ends of the slide 2, and a plurality of rollers 23 that are connected pivotally to each of the roller supports 22, that are received in the second channel 115 of each horizontal frame member 11, and that are slidable along the flange plates 114 of the corresponding horizontal frame member 11.

With reference to FIGS. 3, 7, 9, and 11, the pleated blind 3 has top and bottom ends connected detachably and respectively to the horizontal frame members 11, and first and second positioning plates 32, 33 fixed respectively to two opposite ends of the pleated blind 3 between the top and bottom ends. The first positioning plate 32 is inserted removably into the first channel 123 of the left vertical frame member 12 through the passage 1241 of the flange plates 124, while the second positioning plate 33 is inserted removably into the blind-engaging groove 213 of the slide 2 through the passage 2141 of the ribs 214. The first and second positioning plates 32, 33 are blocked correspondingly by the flange plates 124 and the ribs 214. By pulling the slide body 21, the pleated blind 3 can be moved to an extended position or a folded position. When the pleated blind 3 is folded, it is received in the blind-receiving groove 215 of the slide 2. The wing plates 211 are extendable to abut against the first positioning plate 32 when the pleated blind 3 is folded so as to enclose the same.

The modular window blind assembly of the present invention further comprises two guide cords 34, two first hook members 35, two second hook members 36, and a plurality of resilient retaining members 37.

Each of the guide cords 34 extends through the first and second positioning plates 32, 33 and the pleated blind 3, and has a first end 341 extending toward the left vertical frame member 12 and positioned on the first positioning plate 32, and a second end 342 opposite to the first end 341 and extending out of the second positioning plate 33, as shown in FIG. 7.

The first hook members 35 are fastened detachably to the first positioning plate 32. The first ends 341 of the guide cords 34 are connected respectively to the first hook members 35.

Each of the second hook members 36 has a hook plate 361 (see FIGS. 3 and 4) inserted removably into the engaging groove 133 of the respective corner connector 13 that is connected to the right vertical frame member 12 and the corresponding horizontal frame member 11. The second ends 342 of the guide cords 34 are connected respectively to the second hook members 36. The second ends 342 of the guide cords 34 intersect each other after extending out of the second positioning plate 33 (see FIG. 11), and move toward the right vertical frame members 12 via the first channels 113 of the horizontal frame members 11 so as to connect to the second hook members 36, respectively.

Figure 3:
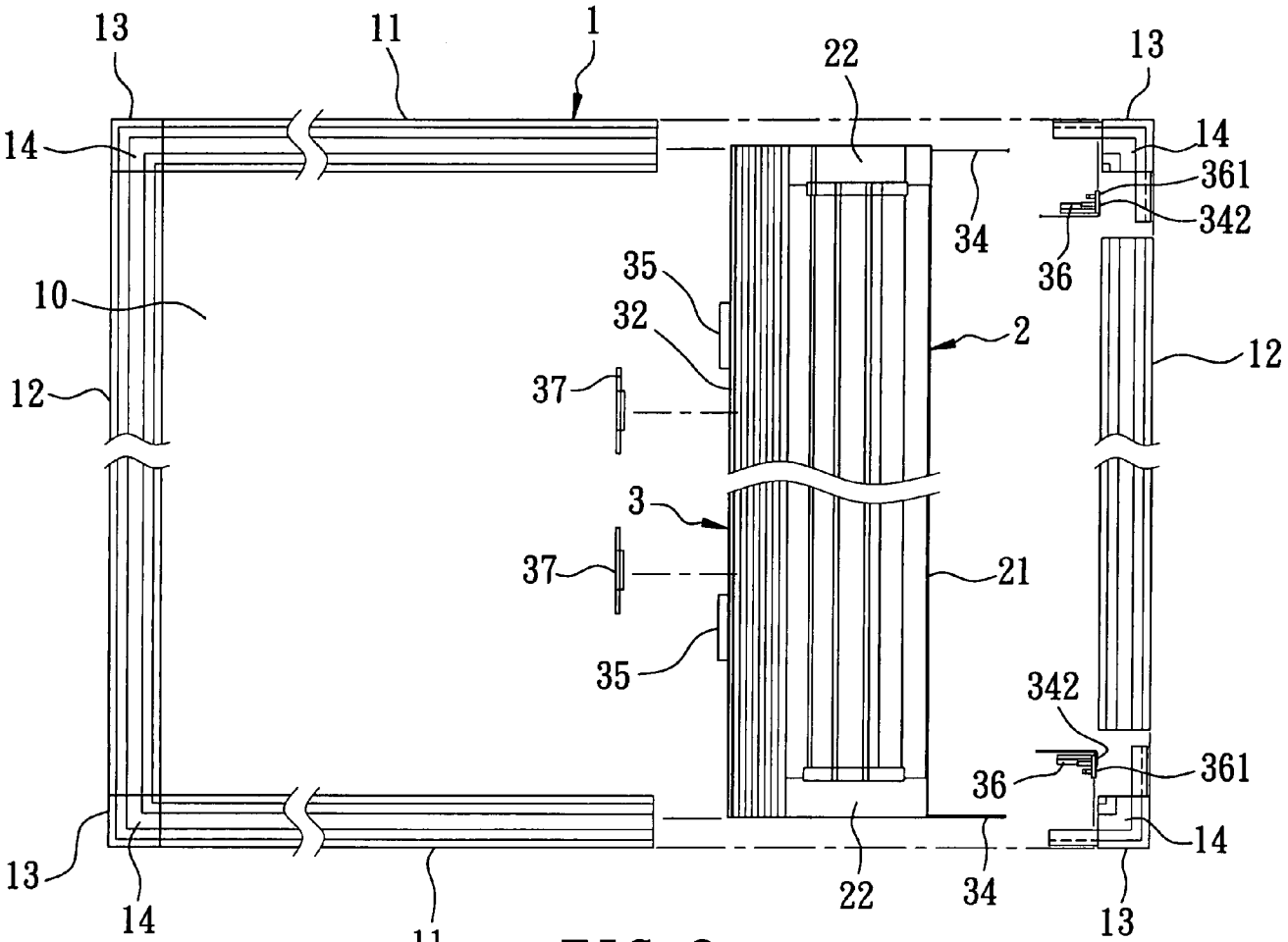
FIG. 3 is a fragmentary partly exploded schematic view of the first preferred embodiment of a modular window blind assembly according to the present invention.
Figure 4:
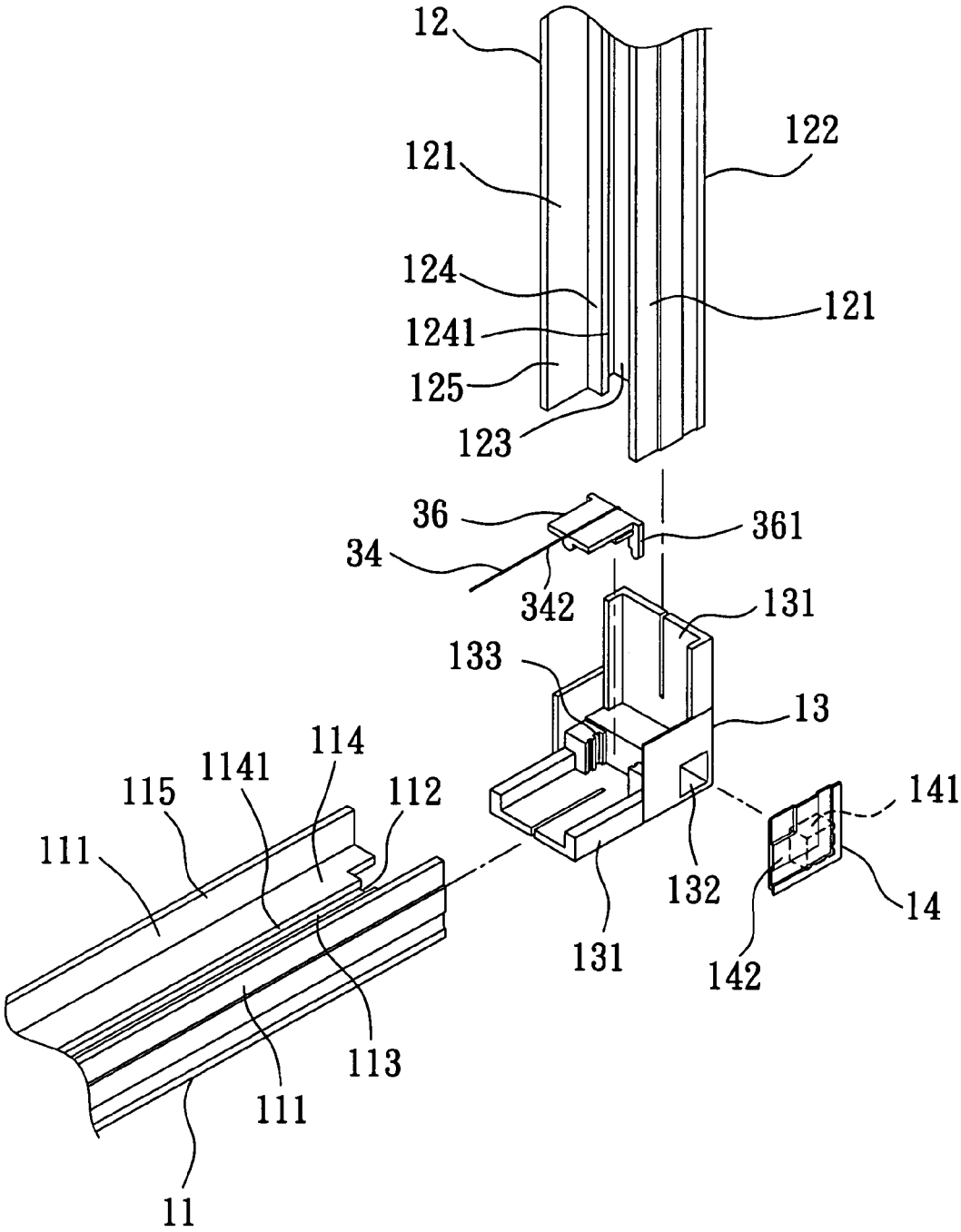
FIG. 4 is a fragmentary exploded perspective view of the first preferred embodiment.
Figure 8:
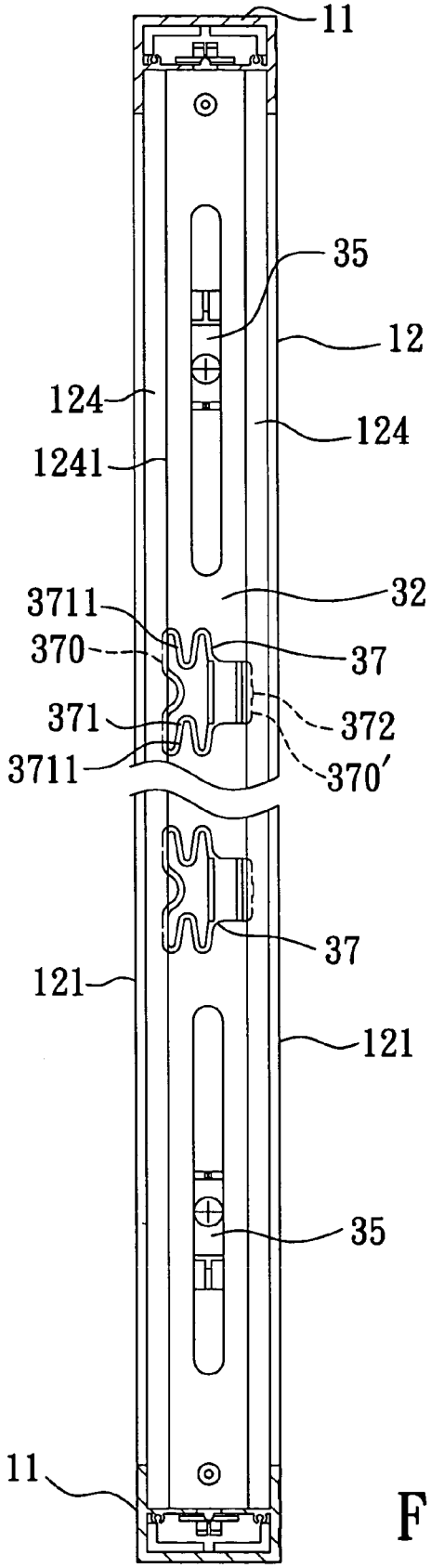
FIG. 8 is a fragmentary sectional side view of a vertical frame member of the first preferred embodiment.

With reference to FIGS. 3, 7, and 8, the resilient retaining members 37 are inserted removably into the first channel 123 of the left vertical frame member 12 in a vertically spaced apart relationship. Each of the retaining members 37 has first and second ends 370, 370', each of which extends in between the first positioning plate 32 and one of the flange plates 124, so that the first positioning plate 32 is prevented from moving out of the first channel 123 of the left vertical frame member 12. Each retaining member 37 has a spring portion 371 and a plate portion 372. The spring portion 371 extends to the first end 370, and is a non-circular ring that has a plurality of compressible U-bent sections 3711. The plate portion 372 projects outwardly from one side of the spring portion 371, and extends to the second end 370'.

Figure 5:
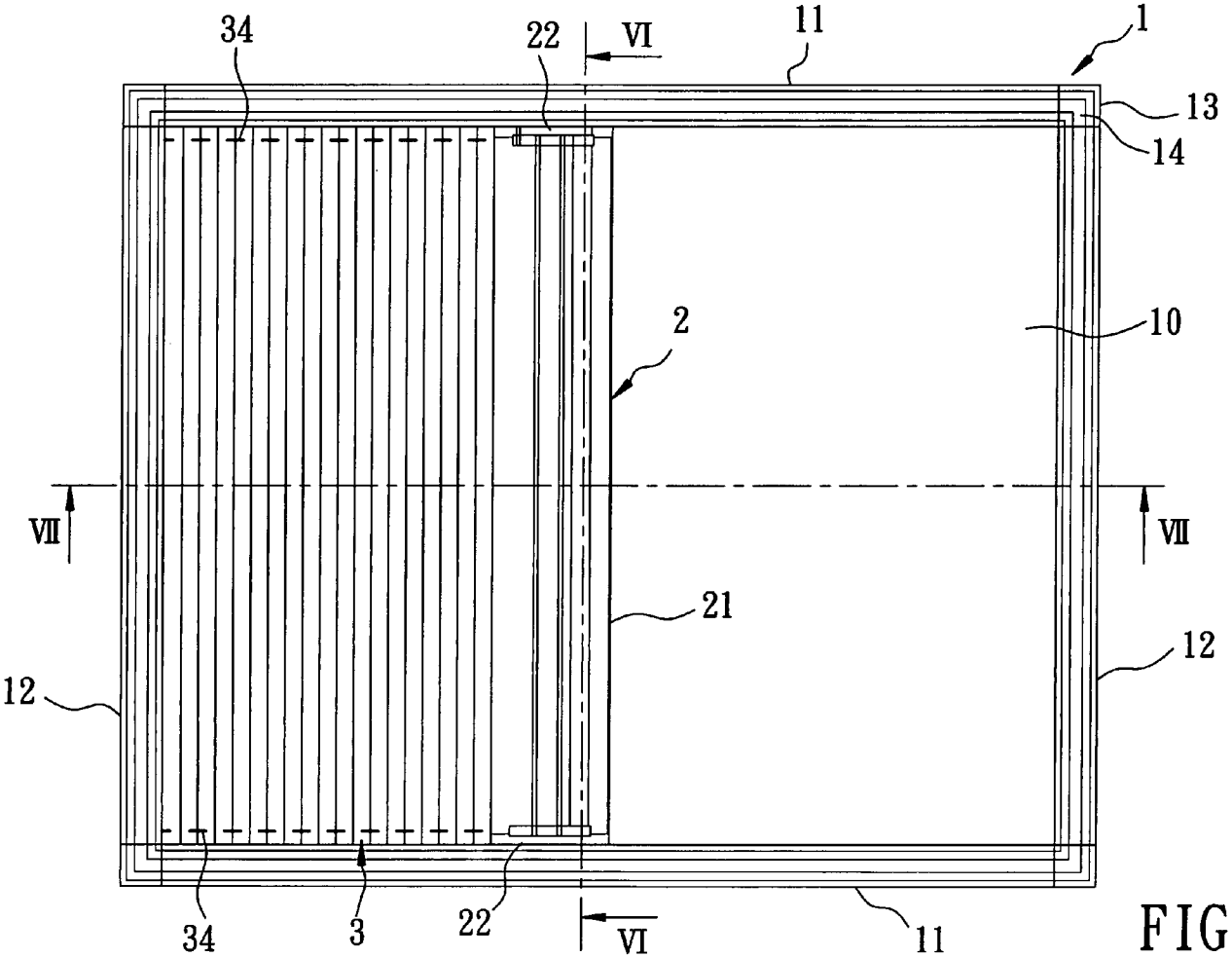
FIG. 5 is an assembled schematic view of the first preferred embodiment.
Figure 6:
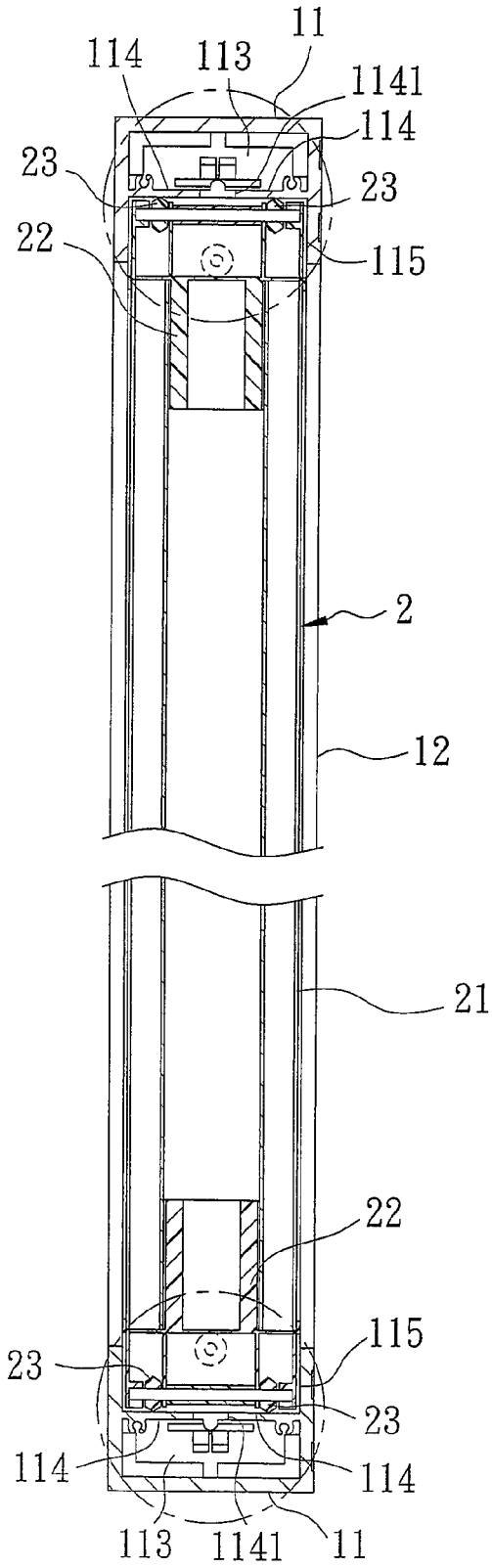
FIG. 6 is a fragmentary sectional view of the first preferred embodiment taken along line VI-VI of FIG. 5.

In use, with reference to FIG. 5, the slide body 21 is simply pulled away from or pushed toward the left vertical frame member 12 along the horizontal frame members 11 so as to unfold or fold the pleated blind 3, thereby covering or exposing the window opening 10 of the blind-mounting frame 1.

It should be noted that the blind-mounting frame 1 may be directly connected to the window/door frame (not shown) through four fastening units (not shown) that pass through the through holes 132 in the respective connectors 13 and engage the window/door frame, or may be directly fitted to the window/door frame or a wall hole.

Figure 9:
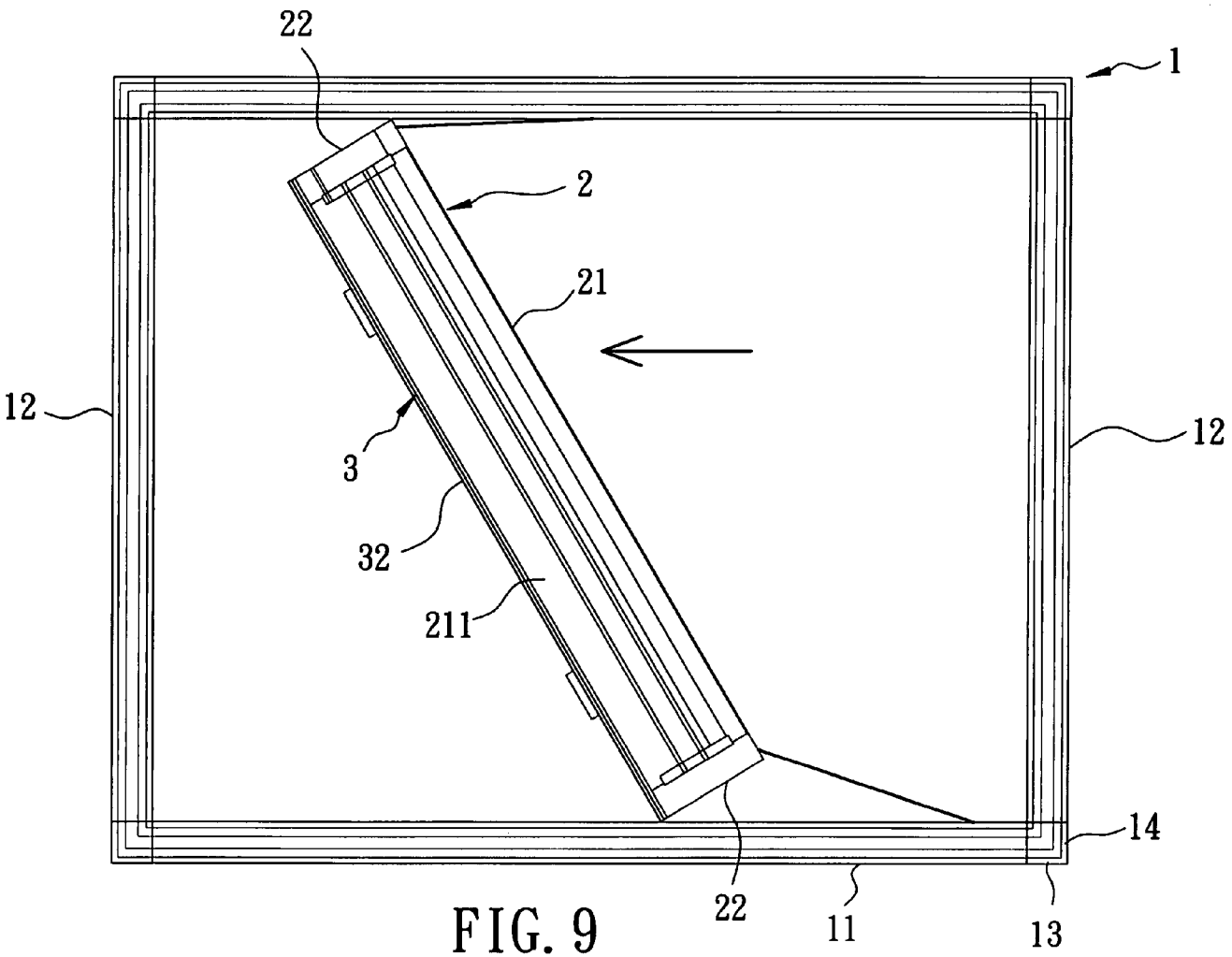
FIG. 9 is a schematic view of the first preferred embodiment, illustrating how an assembly of a pleated blind and a slide can be removed from a blind-mounting frame.

Further, when a portion of the pleated blind 3 or one of the guide cords 34 is damaged, or when the pleated blind 3 is to be replaced, the following steps are undertaken. Firstly, the second end 370' of each retaining member 37 is pressed toward the first end 370 so as to compress the spring portion 371 of the corresponding retaining member 37. Each retaining member 37 can then be removed from the first channel 123 of the left vertical frame member 12 through the passage 1241. Subsequently, the first positioning plate 32 together with one end of the pleated blind 3 can be similarly pulled out of the first and second channels 123, 125 of the left vertical frame member 12. With reference to FIGS. 3 and 9, the slide body 21 is moved toward the first positioning plate 32 so that the wing plates 211 can enclose therewithin the pleated blind 3, after which the slide 2 and the pleated blind 3 are pushed to incline relative to the horizontal frame members 11, and the second hook members 36 are disengaged from the corresponding corner connectors 13. Hence, the slide 2 together with the pleated blind 3 can be separated from the blind-mounting frame 1.

Figure 10:
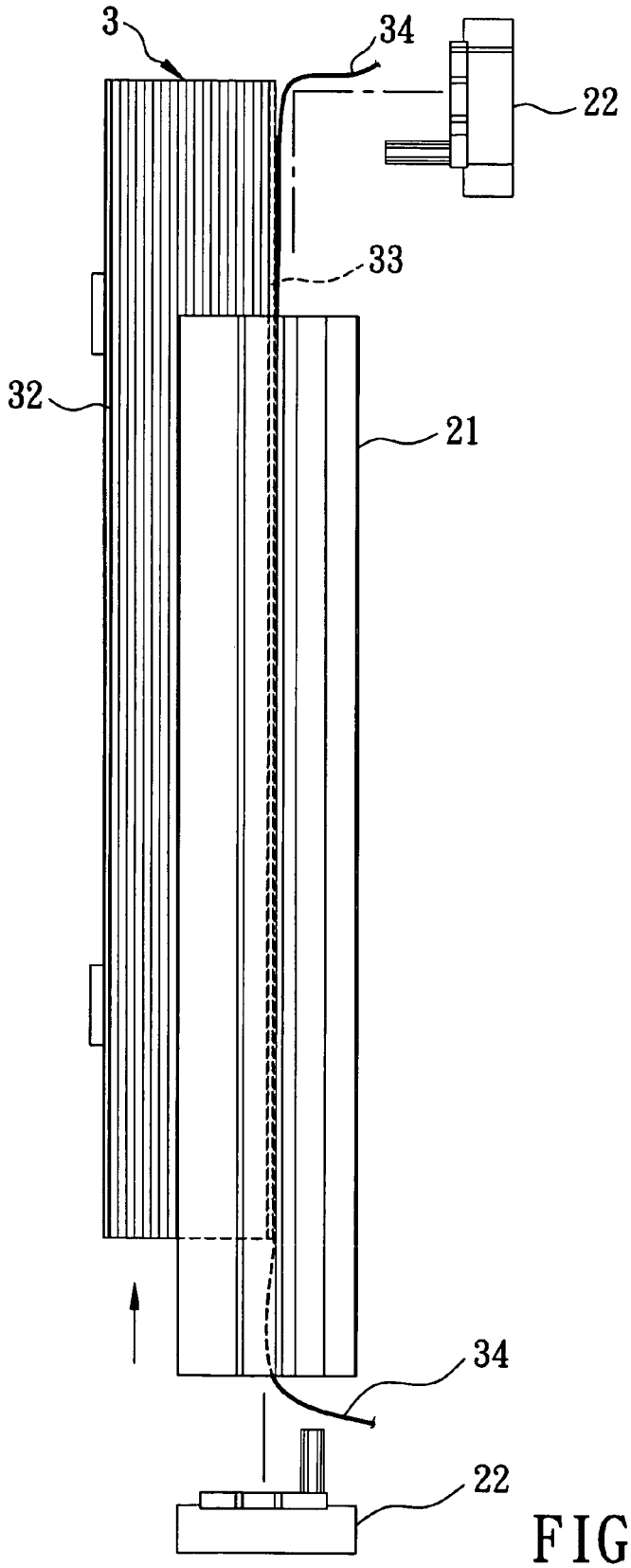
FIG. 10 illustrates how the pleated blind can be removed from the slide.
Figure 11:
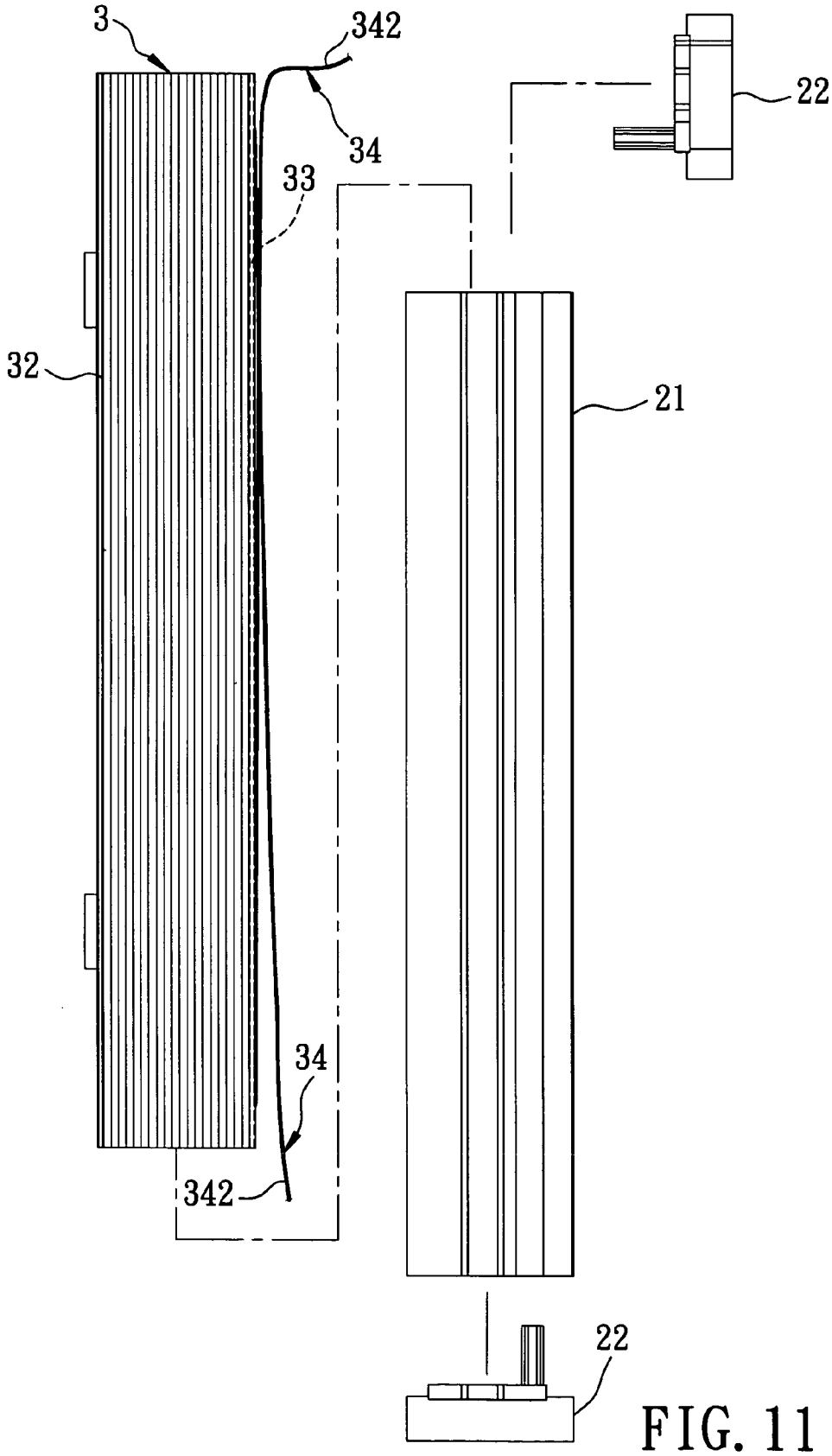
FIG. 11 is a view similar to FIG. 10, but with the pleated blind separated from the slide.

With reference to FIGS. 7, 10 and 11, after the slide 2 together with the pleated blind 3 are separated from the blind-mounting frame 1, the roller supports 22 are then disengaged from the slide 2, and the second positioning plate 33 and the other end of the pleated blind 3 are slid out of the first and second channels 213, 215 of the slide 2, respectively, thereby separating the pleated blind 3 from the slide 2. Each guide cord 34, at this time, can be separated from the pleated blind 3 by disengaging the first or second end 341, 342 from the corresponding first or second hook member 35, 36.

Finally, after the damaged component, i.e., the pleated blind 3 or the guide cord 34, is repaired or replaced, by simply reversing the aforesaid steps, the pleated blind 3 and the slide 2 can be mounted back to the blind-mounting frame 1.

Figure 12:
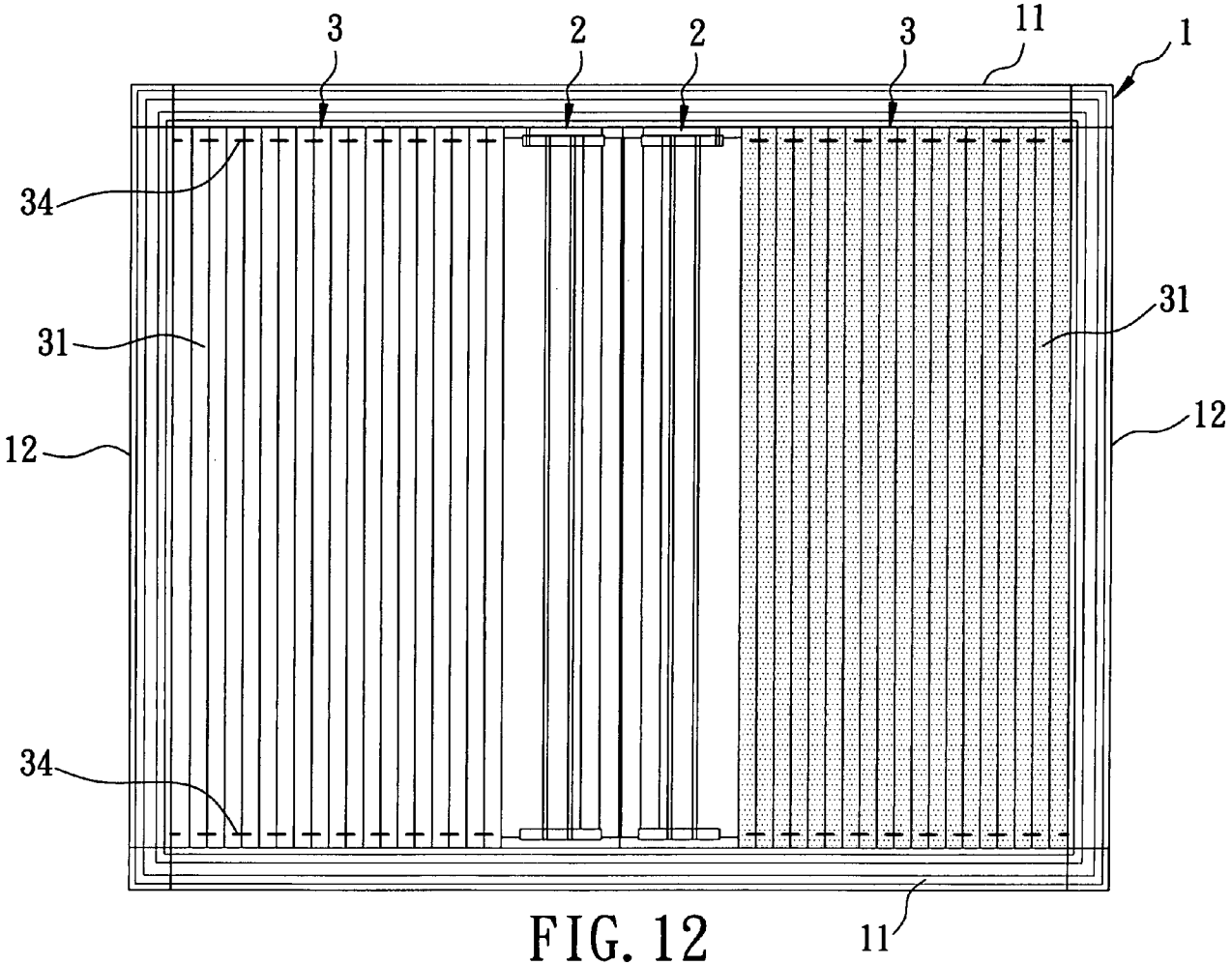
FIG. 12 is a schematic view of the second preferred embodiment of a modular window blind assembly according to the present invention.

Referring to FIG. 12, the modular window blind assembly according to the second preferred embodiment of the present invention is shown to be similar to the first preferred embodiment. However, in this embodiment, the modular window blind assembly includes left and right slides 2 and left and right pleated blinds 3 mounted detachably within the blind-mounting frame 1. Assembly and disassembly of the slides 2 and the pleated blinds 3 are performed similarly to the manner in which assembly and disassembly take place in the aforementioned first preferred embodiment. The slides 2 and the pleated blinds 3 are structured such that the left slide 2 and the left pleated blind 3 are mirror images of the right slide 2 and the right pleated blind 3. One of the left and right pleated blinds 3 may be made of sunshading fabric, while the other one of the left and right pleated blinds 3 may be made of netted fabric.

The advantages of the modular window blind assembly of the present invention can be summarized as follows:

1. Since the slide 2 and the pleated blind 3 of the present invention are detachably connected to each other and to the blind-mounting frame 1, assembly and disassembly of the same are easy and simple, thereby allowing the user to perform these operations by himself or herself.

2. Since the slide 2 and the pleated blind 3 of the present invention are easy and simple to assemble and disassemble, repair or replacement of the same is also simple and safe. Further, each of the slide 2 and the pleated blind 3 does not occupy a substantial space, so that repair or replacement can be done on the spot.

3. Since the pleated blind 3 is received in the blind-receiving groove 215 of the slide 2 when folded so that it does not occupy a substantial space, when repair or replacement cannot be done on the spot and the pleated blind 3 must be sent to a factory for repair, the pleated blind 3 can be packed and transported conveniently.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A modular window blind assembly comprising:

a blind-mounting frame adapted to be mounted on a window/door frame, and including two vertical frame members, and two horizontal frame members between said vertical frame members;

a pleated blind having top and bottom ends adjacent to and sliding relative to said horizontal frame members, and opposite first and second positioning plates provided respectively at two opposite ends of said pleated blind between said top and bottom ends, said first positioning plate being connected detachably to one of said vertical frame members;

a slide mounted removably between and slidable relative to said horizontal frame members, said slide being connected detachably to said second positioning plate, and having a receiving space to receive substantially entirely said pleated blind when said pleated blind is folded;

four corner connectors each interconnecting one end of one of said horizontal frame members to one end of the corresponding one of said vertical frame members and each having an engaging groove;

at least two guide cords each extending through said first and second positioning plates and said pleated blind and having opposite first and second ends;

two first hook members connected to said first positioning plate, said first ends of said guide cords being connected respectively to said first hook members; and two second hook members inserted removably and respectively into said engaging grooves of two of said corner connectors that are disposed respectively on top and bottom ends of one of said vertical frame members, said second ends of said guide cords being connected respectively to said second hook members;

wherein one of said guide cords extends outwardly and downwardly from said second positioning plate to a lower one of said horizontal frame members so as to connect with one of said second hook members, the other one of said guide cords extending outwardly and upwardly from said second positioning plate to an upper one of said horizontal frame members so as to connect with the other one of said second hook members.

2. The modular window blind assembly of claim 1, wherein each of said horizontal and vertical frame members has a substantially U-shaped cross section, and has two spaced-apart side plates, an end plate interconnecting said side plates, and two flange plates projecting respectively from inner surfaces of said side plates toward each other and defining a passage there between, said first positioning plate spanning said passage of said one of said vertical frame members and being placed removably between said end plate and each of said flange plates.

3. The modular window blind assembly of claim 2, further comprising a retaining member inserted removably into said one of said vertical frame members and spanning said passage, said retaining member having opposite first and second ends each of which extends in between said first positioning plate and one of said flange plates so that said first positioning plate is prevented from moving out of said one of said vertical frame members.

4. The modular window blind assembly of claim 3, wherein a plurality of said retaining members are provided in a vertically spaced apart relationship.

5. The modular window blind assembly of claim 1, wherein said slide includes a slide body, two spaced-apart vertically extending wing plates, and a vertically extending cross plate interconnecting said wing plates and connected to said slide body, said wing plates moving close to said cross plate cooperatively defining said receiving space, said wing plates moving close to said first positioning plate when said pleated blind is folded.

6. The modular window blind assembly of claim 5, wherein said slide further includes two vertically extending ribs projecting respectively from inner surfaces of said wing plates toward each other, said ribs defining in said receiving space a blind-engaging groove adjacent to said cross plate, and a blind-receiving groove away from said cross plate, said second positioning plate being inserted removably into said blind-engaging groove through said ribs, said pleated blind being received in said blind-receiving groove when folded.

7. The modular window blind assembly of claim 1, wherein said slide includes two roller supports connected detachably and respectively to top and bottom ends of said slide, and a roller connected pivotally to each of said roller supports and received slidably in each of said horizontal frame members.

* * * * *